US006364559B2

(12) United States Patent
Brown et al.

(10) Patent No.: US 6,364,559 B2
(45) **Date of Patent: *Apr. 2, 2002**

2

(54) FOLDER HAVING COVERS WITH SUPPORT PORTIONS

(75) Inventors: Julian Francis Brown, Turleigh (GB); Timothy John Parsey, Chicago, IL (US); Timothy Edward McKeown, Glen Ellyn, IL (US); Fred Edward Cecala, Mount Prospect, IL (US)

(73) Assignee: ACCO Brands, Inc., Lincolnshire, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/796,638

(22) Filed: Mar. 2, 2001

Related U.S. Application Data

(62) Division of application No. 09/157,367, filed on Sep. 21, 1998, now Pat. No. 6,213,668.

(51) Int. Cl.[7] ..... B42F 13/00

(52) U.S. Cl. ..... 402/73; 206/509; 281/15.1; 281/36; 281/40; 402/3; 402/26; 402/70

(58) Field of Search ..... 281/36, 37, 38, 281/16, 15.1, 17, 27, 34, 40; 206/509; 402/3, 70, 73, 26, 75; 412/17

(56) References Cited

U.S. PATENT DOCUMENTS

| | | | | |
|---|---|---|---|---|
| 849,973 | A | 4/1907 | Buchan | |
| 871,610 | A | 11/1907 | Nash | |
| 1,020,561 | A | 3/1912 | Krumming | |
| 1,109,345 | A | 9/1914 | Mawbey | 281/37 |
| 1,369,309 | A | 2/1921 | Trussell | 402/70 |
| 1,724,407 | A | 8/1929 | Lotter | |
| 1,887,530 | A | 11/1932 | Trussell | |
| 1,923,081 | A | 8/1933 | Elsner | 24/2 |
| 2,512,415 | A | 6/1950 | Buenger et al. | 129/24 |
| 3,074,744 | A | 1/1963 | Pucci et al. | 281/37 |
| 3,132,649 | A | 5/1964 | Gits | 129/24 |
| 3,201,145 | A | 8/1965 | Libby | 281/29 |
| 3,315,325 | A | 4/1967 | Cornelius | 24/66 |
| 3,335,508 | A | 8/1967 | Hummel | 40/10 |

(List continued on next page.)

FOREIGN PATENT DOCUMENTS

| | | |
|---|---|---|
| CA | 750 260 | 1/1967 |
| DE | 377 195 | 6/1923 |
| DE | 1 436 113 | 11/1968 |
| DK | 1436175 | 6/1969 |
| FR | 731 642 | 9/1932 |
| FR | 970 197 | 1/1951 |
| FR | 1 525 272 | 5/1968 |
| FR | 2 666 276 | 3/1992 |
| GB | 523502 | 7/1940 |
| GB | 1313254 | 8/1968 |
| GB | 1 214 477 | 12/1970 |
| GB | 2 030 074 | 4/1980 |
| NL | 44995 | 1/1939 |

*Primary Examiner*—A. L. Wellington
*Assistant Examiner*—Monica Carter
(74) *Attorney, Agent, or Firm*—Pennie & Edmonds LLP

(57) ABSTRACT

A folder that has a spine that is hinged to two covers. The preferred covers have a convex portion that extends around a binding mechanism over most of the distance of that the binding mechanism protrudes inwardly from the spine support portion that extends outwardly with respect to a portion of the cover pivotably attached to the spine. A concave portion is located adjacent the convex portion towards the free end of the binder. The preferred folder portion of the binder has projections that are deformed through openings in the binding mechanism to secure the binding mechanism to the folder. A preferred cover has an arcuate cross-section extending parallel to the hinges.

35 Claims, 7 Drawing Sheets

U.S. PATENT DOCUMENTS

| | | | | |
|---|---|---|---|---|
| 3,572,957 | A | 3/1971 | Strassberg | 402/75 |
| 3,771,890 | A | 11/1973 | Notto | 402/21 |
| 3,837,680 | A | 9/1974 | Cimini | 281/16 |
| 3,968,546 | A | 7/1976 | Seaborn et al. | 24/67.9 |
| 4,114,240 | A | 9/1978 | Nackenson | 24/67.11 |
| 4,295,747 | A | 10/1981 | Errichiello | 402/75 |
| 4,315,642 | A | 2/1982 | Errichiello | 281/33 |
| 4,569,613 | A | 2/1986 | Thomas | 402/80 R |
| 4,583,877 | A | 4/1986 | Wilson | 402/75 |
| 4,588,321 | A | 5/1986 | Egly | 402/77 |
| 4,630,843 | A | 12/1986 | Willat | 281/30 |
| 4,856,817 | A | 8/1989 | Moor | 281/29 |
| D316,872 | S | 5/1991 | Witschi | D19/27 |
| 5,015,011 | A | 5/1991 | York | 281/18 |
| 5,108,212 | A | 4/1992 | Lee | 102/75 |
| 5,209,593 | A | 5/1993 | Ros | 402/77 |
| 5,213,368 | A | 5/1993 | Wyant | 281/18 |
| 5,222,825 | A | 6/1993 | Wyant | 402/76 |
| 5,273,319 | A | 12/1993 | Lee | 281/29 |
| 5,351,992 | A | 10/1994 | Chilson et al. | 281/31 |
| D352,309 | S | 11/1994 | Gresham et al. | D19/27 |
| D366,496 | S | 1/1996 | Yiu | D19/32 |
| 5,553,959 | A | 9/1996 | Feldman et al. | 402/79 |
| 5,620,207 | A | 4/1997 | Podosek et al. | 281/29 |
| 5,672,022 | A | 9/1997 | Lin | 402/73 |
| 5,695,295 | A | 12/1997 | Ayele et al. | 402/80 R |
| 6,213,668 | B1 * | 4/2001 | Brown et al. | 402/26 |

* cited by examiner

FOLDER HAVING COVERS WITH SUPPORT PORTIONS

This is a Divisional Application of U.S. patent application Ser. No. 09/157,367, filed Sep. 21, 1998, now U.S. Pat. No. 6,213,668.

BACKGROUND OF THE INVENTION

Loose leaf binders typically have two covers that pivot with respect to a binding assembly. Most binders have a spine connecting the covers.

U.S. Pat. No. 3,771,890 teaches a loose-leaf binder formed from a single piece of molded plastic. The binder has only a front and a back cover joined at a flexible portion located at the back of the binder. Each of three split-ring members are mounted to both covers to bias them towards open or closed positions. The covers have curved, directly hinged portions that extend around and are biased by the ring members. Because the covers need to reach completely around the rings, in the open position the shape of the covers lifts papers bound in the rings high above the surface on which the binder is rested when compared to a binder with a spine, which can lay flatter against the surface as the covers are not required to be able to extend completely behind the rings.

Most ring binders, however, have a spine pivotably connected between two covers such that either cover can be opened independently. U.S. Pat. No. 4,295,747, for instance, shows an integrally molded loose-leaf book, in which front and rear cover panels are integrally molded with a spine, and are connected thereto by living hinges. The spine has a rounded contour, and the front and rear cover panels are flat. Thus, when the book laid open on a flat surface in an open position, weight on the cover panels is supported by lateral edges of the cover panels, which rest on the flat surface, and by the living hinges, which are raised above the flat surface by the raised lateral edges of the spine. This can lead to accelerated wear on the hinges, which are already formed as weakened notches.

The '747 patent also discloses mounting posts that are formed on an inner face of the spine. The posts extend through holes in a matrix strip of a snap-ring assembly. The matrix is secured to the posts with rivets or with fingers of the matrix that bite into the posts.

A binder is thus needed which has a spine that connects two covers, but in which stress is relieved from the hinges where the covers meet the spine.

SUMMARY OF THE INVENTION

The invention relates to a binder that includes a folder shell that has a spine pivotably connected to first and second covers. At least one of the covers includes a support portion located between a portion hinged to the spine and an opposite end of the cover. The support portion is disposed further in an outward direction from the hinge portion and from a plane extending between the hinge portion and the other end. Thus, when the folder shell is open, the supporting portion supports loads imposed on the cover, relieving the hinge between the spine and the cover.

The preferred embodiment also has a concave portion in which a support portion of a similarly constructed binder is receivable. This allows the binders to be stacked facing a same direction and facilitates gripping and holding of the binder.

DETAILED DESCRIPTION OF THE PREFERRED EMBODIMENTS

Figure 1:
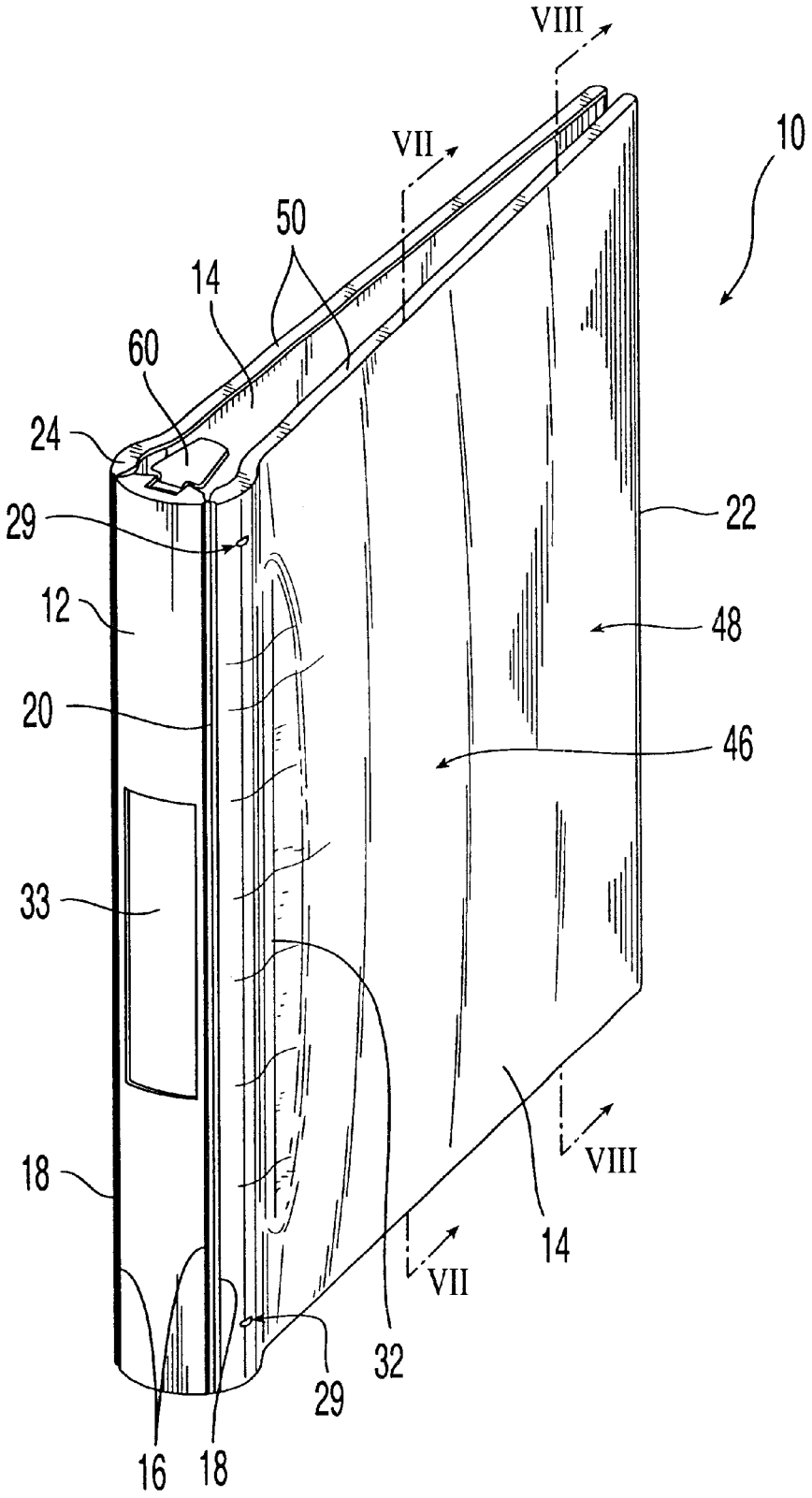
FIG. 1 is a perspective view of a binder constructed according to the present invention.
Figure 2:
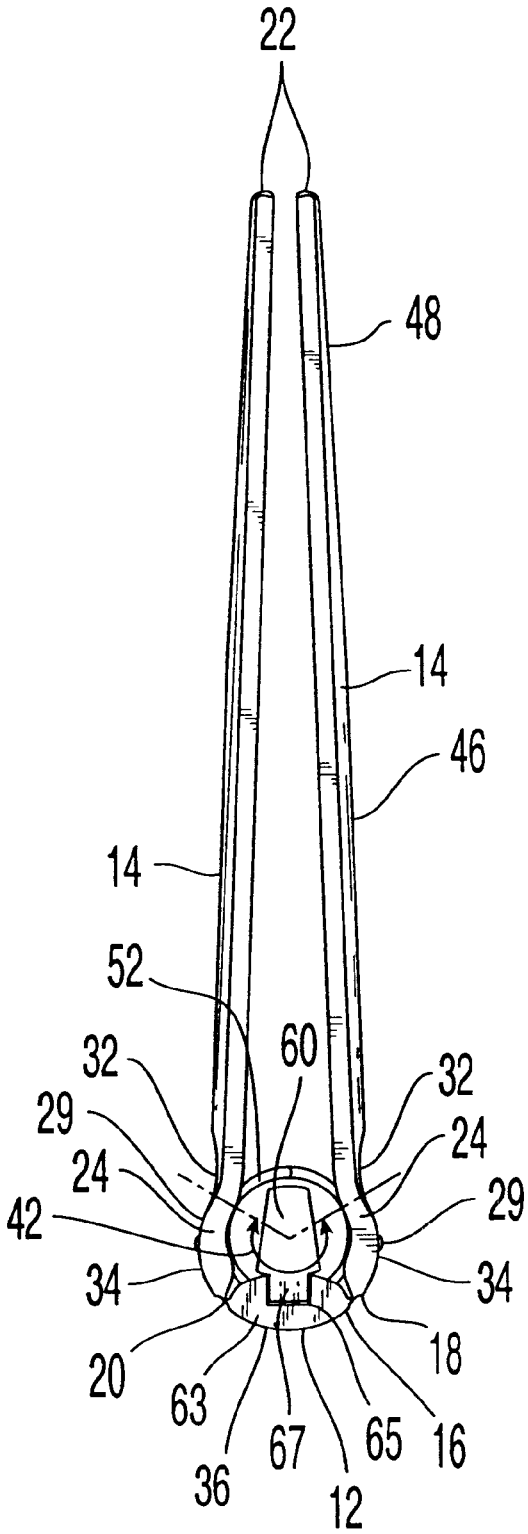
FIG. 2 is a side view of the binder.

Referring to FIGS. 1–2, folder shell 10 preferably has three panels, including a spine 12 and front and back covers 14. The spine 12 is pivotably connected at spine hinge portions 16 to cover hinge portions 18 of the covers 14. The hinge portions 16, 18 are joined preferably by thinned regions of the folder shell 10 that are living hinges 20. The folder shell 10, including the covers 14 and the spine 12 are a molded plastic of a unitary construction, which is at least semirigid. Preferably, only a single layer of plastic is employed, but multiple layers can also be used.

Figure 3:
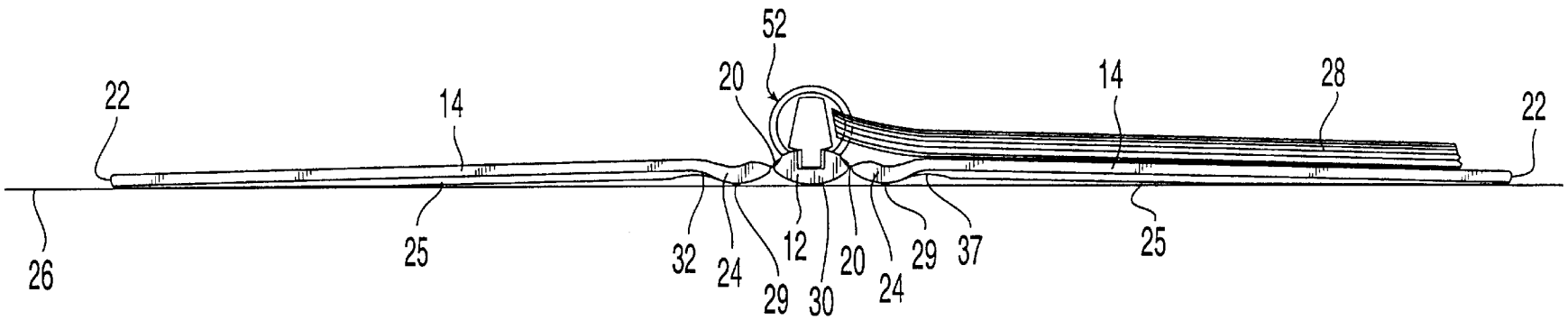
FIG. 3 is a side view thereof in an open position.

The covers 14 have free ends 22 disposed opposite from the hinge portions 18 of the covers 14. Between the free ends 22 and the cover hinge portions 18 are support portions 24. Each support portion 24 is disposed further outwardly than each cover hinge portion 18, and further outwardly than a plane or surface that extends between the hinge portion 18 and either the free end 22 of each cover 14. Thus, as shown in FIG. 3, the support portions 24 are configured such that when the folder shell 10 is in an open position shown with the covers 14 spread apart, the support portions 24 and a resting portion 25 of the covers disposed beyond the support portions 24 with respect to the spine 12, such as the free ends 22, are disposed substantially in a common plane against a planar surface 26 on which the folder is laid. As a result, loads imposed on the covers 14 by papers 28 held in the binder are supported by the support portions 24 and the resting portions 25, instead of by the weakened hinges 20.

Also, the spine 12 has a base 30 disposed between the spine hinge portions 16 and disposed outwardly therefrom and from a plane or surface extending between the spine hinge portions 16. Preferably the spine base 30 is also disposed near or substantially against the surface 26 in the common plane with the support portions 24 and resting portions 25 when the folder shell 10 is open, but can be disposed above the surface 26. The spine 12 also includes a recessed portion 33 configured for receiving and locating a label to identify the binder.

Figure 4:
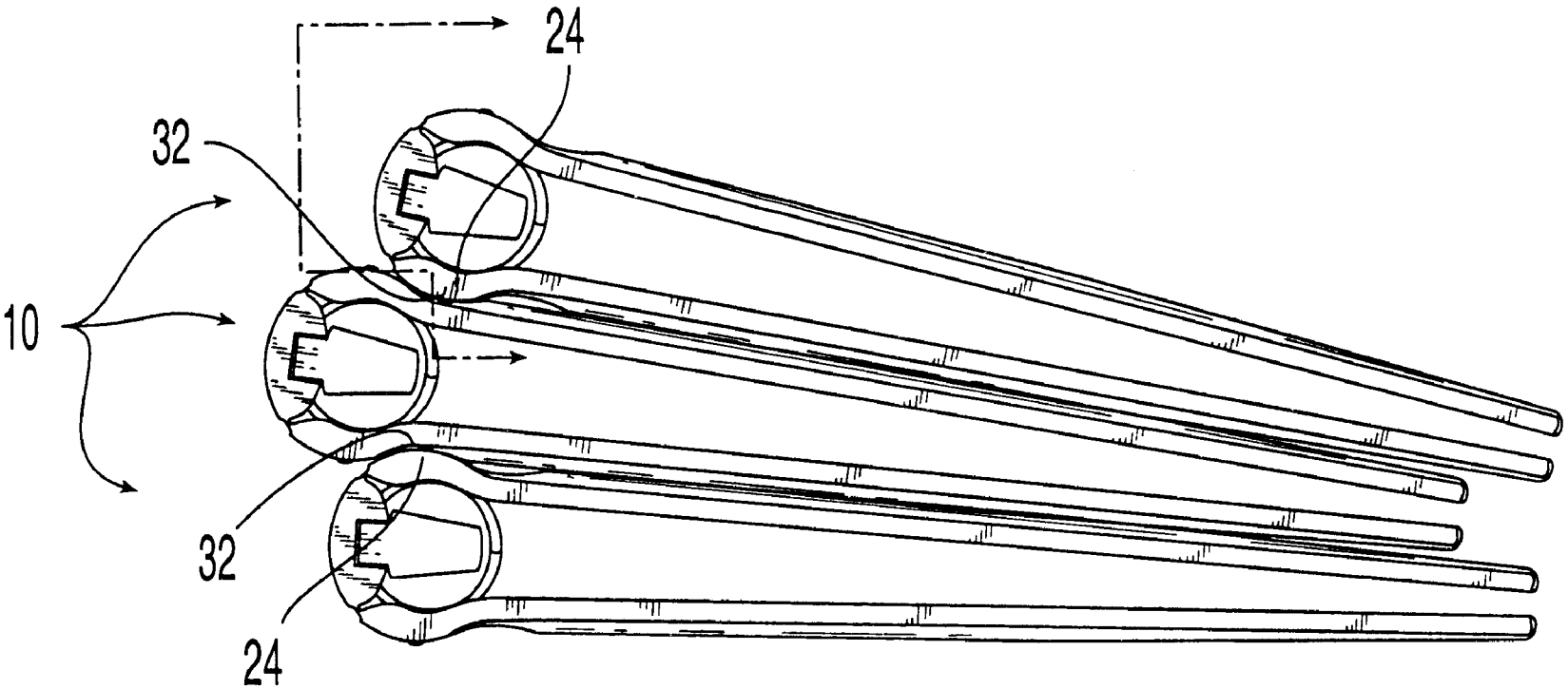
FIG. 4 is a side view of a stack of several binders constructed according the invention.

The support portion 24 are generally convex. Between the support portion 24 and the free ends 22 or resting portions 25 are concave portions 32, which are preferably disposed adjacent the support portion 24, forming an S-curve therewith. Each concave portion 32 is configured to receive the support portions of another similarly constructed folder shell, as shown in FIG. 4. Each concave portion 32 preferably has a semi-cylindrical surface that substantially corresponds with the shape of the semi-cylindrical surface of the support portion 24 of the other cover 14. As a result, two similar folder shells 10 can be stacked facing in a same direction with support portion 24 received in concave portions 32 to restrict or prevent lateral sliding therebetween.

The support portion 24 and spine 12 have exterior surfaces 34, 36 substantially in continuation of each other, which together define a generally rounded contour when the folder shell 10 is in the closed position shown in FIG. 2. The rounded contour makes the binder easier to grasp and hold by a user and allows the folder 10 to be stood upright on the top or bottom sides or longitudinal edges 50. The rounded contour preferably extends along an elliptical or circular shape over an angle 42 of at least about 185° C. of a generally elliptical shape. The preferred outer radius of the spine 12 is preferably slightly larger than that of the support portions 24.

Figure 5:
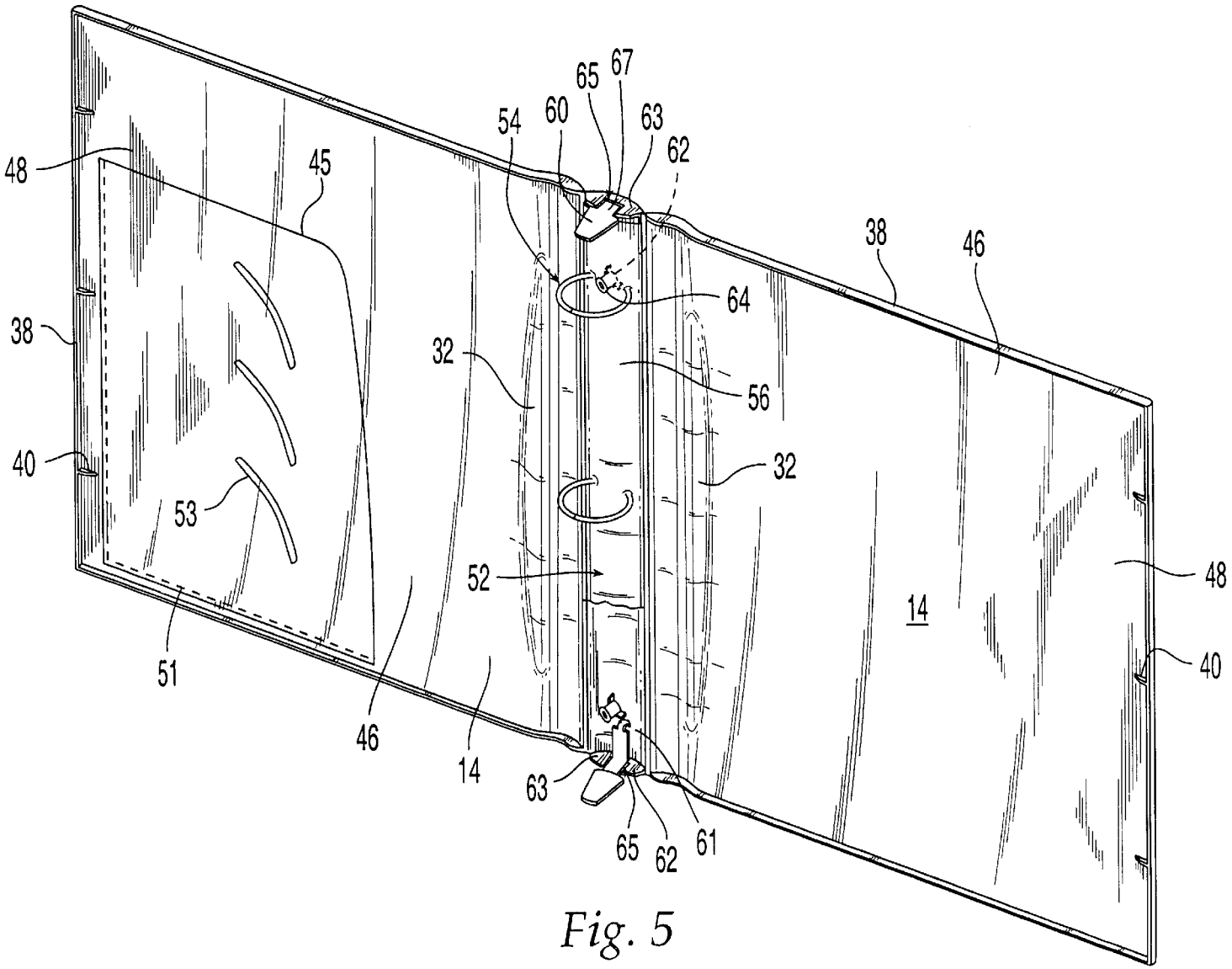
FIG. 5 is a perspective view of the binder in the open position.

As shown in FIG. 5, at or near the perimeter of the covers 14 is a perimetral ridge 38 that extends at an angle of preferably more than about 45° C. , and more preferably about 90° C. from the covers 14. The covers 14 may blend smoothly into the ridge 38 so only the tip of the ridge is near 90° C. from the covers 14. A plurality of webs 40, preferably three on each cover 14, reinforce ridge 38. The webs 40 preferably connect the portion of the ridge 38 extending along the free ends 22 of the covers 14 to the remainder of the cover 14.

Figure 6:
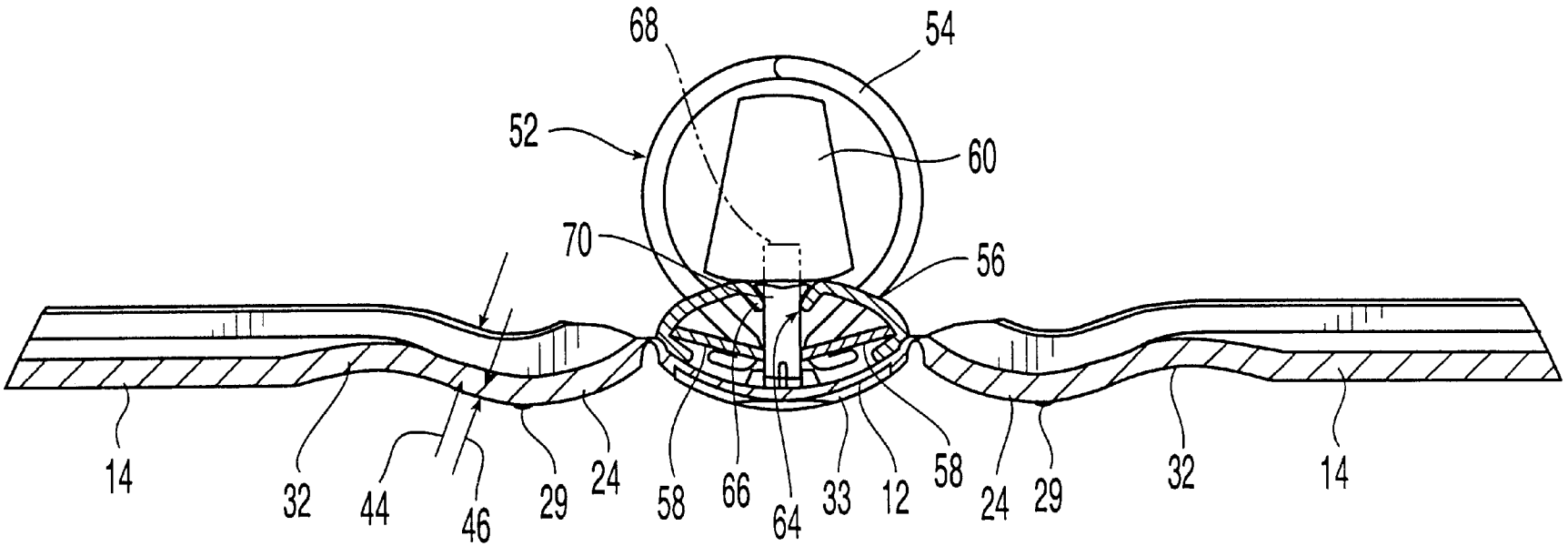
FIG. 6 is a cross-sectional side view of the spine and covers of another embodiment of the binder.

The height 42 of the ridge 38 is preferably about equal to or greater than the thickness 44 of the front and back portions of the covers 14, as shown in FIG. 6.

Also shown in FIG. 5 is a plastic pocket 45 that is heat sealed to one of the covers 14 and is open at the top and facing the spine 12 at dashed line 51. The pocket is preferably a polypropylene film with slits 53 shaped to receive business cards.

Preferably the plastic material for which the folder shell 10 is molded is translucent, so the contents of the pocket or of the papers bound in the binder are at least partially visible from the outside. In addition, the inside of the concave portions 32 is convex, and the inside of the support portions 24 is concave, as the folder shell 10 is constructed with a generally constant thickness.

Figure 7:
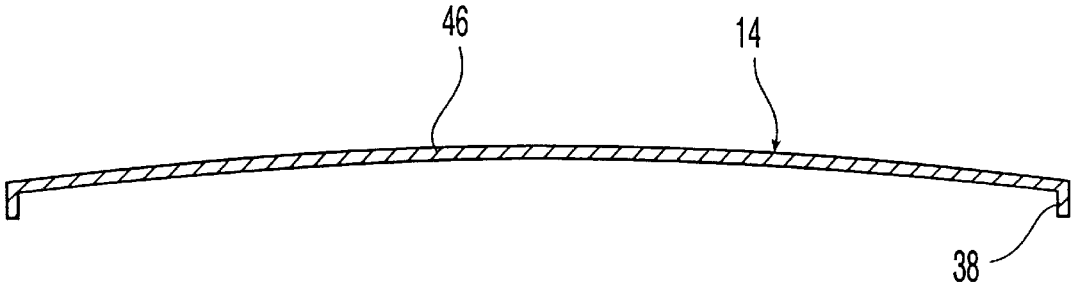
FIG. 7 is a cross-sectional view along section VII—VII of FIG. 1.
Figure 8:
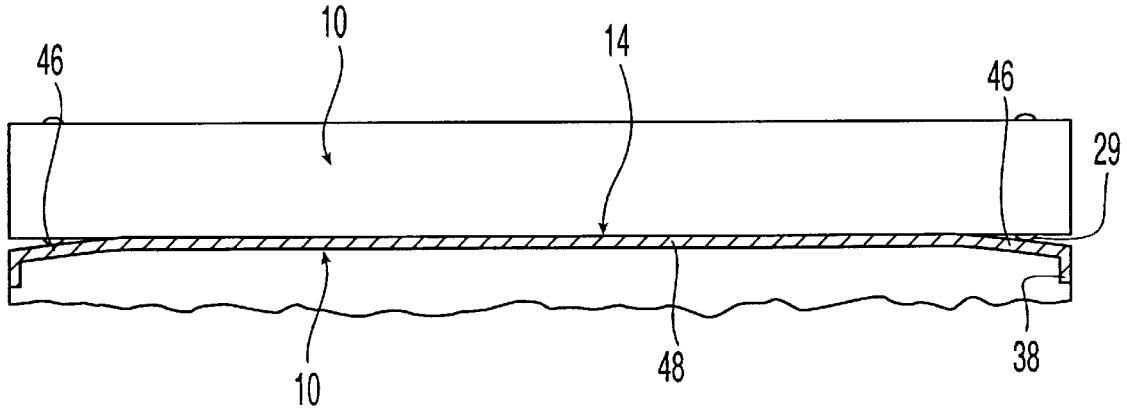
FIG. 8 is a cross-sectional view along section VIII—VIII of FIG. 1 with another similar binder stacked on the binder of FIG. 1.

Referring again to FIGS. 1 and 7–8, the each cover 14 has a arcuate portion 46 with an arcuate cross-section. Extending from the free end 22 is a substantially planar portion 48 that has a less arcuate cross-section than the arcuate portion 46. Thus, the free ends 22 are generally straight, and the curved covers 14 have increased strength compared to flat covers. In the preferred embodiment, the substantially planar portion 48 is generally triangular. In an alternative embodiment, the arcuate portion 46 extends up to the free end 22, with the cross-section flattening as it nears the free end 22.

As the concave portion 32 of each cover 14 is semi-cylindrical, and because the outer surface of the concave portion 32 is disposed outwardly from top and bottom or longitudinal edges 50 of each cover 14, the perimeter of the concave portion 32 is generally elliptical.

As shown in FIG. 6, the support portion 24 can have a toe 29 for improving traction when the folder shell 10 is laid on one of the covers 14. There are preferably four toes 29, which are preferably laterally elongated bumps, as shown in FIG. 1. Referring to the stacked binders of FIG. 8, The toes 29 of the top binder are disposed longitudinally beyond the elliptical extend of the concave portion 32. Also, the toes 29 preferably extend outwardly from the supporting portion 24 by less than the distance between the continuation of the spherical surface of the concave portion 32 and the arcuate portion 46, such that the toes fit therebetween without lifting the support portion 24 of the top folder shell 10 from the concave portion 32 of the bottom folder shell 10. Thus, the toes prevent longitudinal sliding of one folder shell 10 with respect to the other when the toes 29 engage the arcuate portion disposed longitudinally adjacent and inwardly with respect to the concave portion 32. Also, the toes 29 reduce scuffing of the support portions 24.

A binding assembly 52 is attached to the folder shell 10, preferably to the spine 12, but may also be attached to one of the covers 14. The binding assembly 52 with the folder shell 10 preferably forms a three ring binder. The binding assembly 52 is preferably a standard ring binder assembly that includes a three split-rings 54 spaced and configured to attach papers with correspondingly spaced holes. The rings 54 are held by a retainer 56, which in the preferred embodiment is made from a bent sheet of steel. The rings 54 are fixed to an operating mechanism, which preferably includes hinged plates 58 which can be toggled by levers 60 to an open-ring position or a closed-ring position shown to open or close the rings 54, respectively.

The spine 12 preferably has a recessed portion 61 adjacent each lever 60 that prevents interference with a bottom portion of the levers 60 when the levers 60 are moved to open and close the rings 54. The spine 12 also has ridges 63 configured with notches 65 associated with the levers 60 to receive a lower part 67 of the levers 60 when they are rotated away from each other to open the rings 54. The ridges 63 preferably follow the general shape of the retainer 56, to protect the retainer 56 from impact.

The folder shell 10 has at least one but preferably a plurality of projections 62, preferably hollow posts, unitarily molded on the inside of the spine 12. In embodiments in which the binding assembly 52 is attached to one of the covers, the projections 62 are unitarily molded to that cover. The preferred projections 62 extends inwardly from the spine 12 and through holes 64 in the retainer 56 of the binding assembly 52. The retainer 56 has preferably conical ferrules 66 defining the holes 64. The plastic from which the folder shell 10 is molded is preferably deformable when heated and may be a thermoplastic or thermoset material. Preferably the plastic is polypropylene. The projections 62 are molded to a diameter receivable within the holes 64, as shown by dashed contour 68. The retainer 56 is placed against the spine 12 with the projections 62 received in the holes 64. The exposed ends of the projections are then heated and deformed to a configuration in which the end 70 is wider than the holes 64. When the deformed projection 64 is cooled, the projection 64 fixes the binding assembly 52 to the folder shell 10.

One of ordinary skill in the art can envision numerous variations and modifications. For example, the covers can be made from two parts that are fixed to each other, one of the parts being molded together with the spine. All of these modifications are contemplated by the true spirit and scope of the following claims.

What is claimed:

1. A binder, comprising:

a spine including first and second spine hinge portions;

a binding mechanism comprising a plurality of binding rings extending inwardly in the binder to a ring distance from the spine; and first and second covers, each comprising:

a cover hinge portion that is pivotably attached to the spine at one of the spine hinge portions, a free end disposed opposite from the cover hinge portion, a substantially convex portion disposed adjacent the cover hinge portion and having an at least semi-rigid connection therewith, the convex portion extending around the binding mechanism along most of the ring distance with the covers closed, and a substantially recessed portion disposed adjacent the convex portion towards the free end;

wherein the spine and convex and recessed portions are configured such that a user's fingers can wrap around more than about 185° C. of the spine and convex portions to facilitate gripping thereof.

2. The binder of claim 1, wherein the spine and covers are of unitary construction of plastic.

3. The binder of claim 1, wherein the spine is at least semi-rigid.

4. The binder of claim 1, wherein the spine and first and second covers have an exterior surface that defines a generally rounded contour when the folder is in a closed position.

5. The folder of claim 4, wherein the generally rounded contour extends over more than about 185° C. of a generally elliptical shape.

6. The folder of claim 1, wherein the convex and concave portions have substantially corresponding shapes for resisting lateral sliding between the binder and a similar binder stacked therewith.

7. The binder of claim 1, wherein the concave portions have a perimeter, and the convex portions includes a mounting projection protruding outwardly therefrom and configured for engaging a longitudinal side of the concave portion perimeter for resisting longitudinal movement with a support portion of a similar binder received in the first concave portion.

8. The binder of claim 1, wherein:

the binding mechanism defines a mounting opening; and at least one of the spine and the covers includes a mounting projection of unitary construction therewith extending inwardly in the binder, the mounting projection comprising an end received through the mounting opening and dimensioned to prevent withdrawal therefrom for attaching the mounting assembly to the at least one of the spine and covers.

9. The binder of claim 8, wherein the mounting projection extends from the spine and attaches the binding mechanism thereto.

10. The binder of claim 1, further comprising a ridge extending near an outer perimeter of the first cover at an angle therefrom for stiffening the first cover.

11. The binder of claim 1, wherein the first cover has an arcuate cross-section extending substantially to adjacent opposite free ends of an outer perimeter of the first cover for stiffening the first cover.

12. A folder for holding a stack of paper, comprising:

first and second covers of at least semi-rigid construction and pivotally connected to each other, the first cover having an outer perimeter;

a first ridge extending near an outer perimeter of the first cover at an angle therefrom and configured for stiffening the first cover.

13. The folder of claim 12, wherein the first cover and first ridge are of unitary construction of plastic material.

14. The folder of claim 12, further comprising webs connecting the first cover and the first ridge for reinforcing the first ridge.

15. The folder of claim 12, wherein the outer perimeter comprises a plurality of sides, and the first ridge extends along a plurality of the sides of the perimeter.

16. The folder of claim 12, further comprising a second ridge extending near an outer perimeter of the second cover at an angle therefrom and configured for stiffening the second cover.

17. The folder of claim 12, wherein the first ridge extends inwardly into the folder generally normally to the first cover.

18. A binder, comprising:

a binding mechanism configured for binding a stack of paper, the binding mechanism defining a mounting opening;

a folder comprising:

a spine including first and second spine hinge portions, and first and second covers connected to the spine by the hinge portions; and a mounting projection extending inwardly from the folder and of unitary construction therewith, the mounting projection comprising an end received through the mounting opening and dimensioned to prevent withdrawal therefrom and thereby attaching the binding mechanism to the folder.

19. The binder of claim 18, wherein the mounting projection comprises a deformable material, and the end of the mounting projection is deformed to a dimension larger than the mounting opening.

20. The binder of claim 18, wherein the binding mechanism defines a plurality of mounting openings, and the mounting projection comprises a plurality of mounting projections received in securing association with the mounting openings.

21. The binder of claim 18, wherein the mounting projection extends from the spine and attaches the binding mechanism thereto.

22. The binder of claim 18, wherein the folder and the mounting projection are made of plastic.

23. A method of making a binder, comprising:

molding a folder shell with a plurality of panels, including first and second covers and molding, an inwardly extending mounting projection on one of the panels;

placing a binding assembly against the one of the panels with a mounting opening of the binding assembly receiving the mounting projection; and deforming an end of the mounting projection to a shape that is wider than the mounting opening to attach the binding assembly to the panel.

24. The method of claim 23, wherein the molding of the one of the panels comprises molding a spine with the mounting projection disposed thereon.

25. The method of claim 23, wherein the shell is molded as a unitary piece.

26. The method of claim 23, further comprising:

heating the mounting projection when received in the mounting opening; and cooling the deformed mounting projection.

27. A folder comprising:

a first cover that is at least semi-rigid and having side edges and a perimeter extending about the side edges; and a second cover pivotally connected with the first cover along a hinge;

wherein the first cover has an outer surface with an arcuate portion that has an arcuate cross-section along a plane extending generally parallel to the hinge.

28. The folder of claim 27, wherein the first cover has a substantially planar portion disposed within the arcuate cross-section, and the arcuate portion extends substantially to the perimeter to said first end.

29. The folder of claim 27, wherein the arcuate cross-section includes inner and outer arcuate surfaces.

30. A binder, comprising:

the folder of claim 27; and a binding mechanism attached to the folder and configured for binding a stack of paper.

31. A folder, comprising:

a spine;

a first cover pivotably attached to one side of the spine;

a second cover pivotably attached at one end to the opposite side of the spine and having an opposite second end;

a raised portion disposed on the second cover adjacent said spine; and a recessed portion on the second cover adjacent said raised portion, the recessed portion being located between said raised portion and said opposite end and configured for receiving said raised portion of another similarly shaped folder for restricting lateral sliding therebetween when the folders are stacked, one upon the other.

32. The folder, of claim 31, wherein the first cover and the second cover each include said raised portion and said recessed portion.

33. The folder of claim 31, wherein:

each raised portion extends along the entire length of said spine; and each recessed portion extends along only a portion of the length of said spine.

34. The folder of claim 31, wherein the raised portion is convex in shape and the recessed portion is concave in shape to define an S-shaped curve.

35. The folder of claim 31, wherein each cover has an outer convex surface portion that is convex in contour as measured in the direction of said spine, said convex surface portion being located between the recessed portion and said opposite end of the cover and at least adjacent said recessed portion to define said S-shaped curve.

* * * * *